US010463136B2

(12) United States Patent
Tatsumi

(10) Patent No.: US 10,463,136 B2
(45) Date of Patent: Nov. 5, 2019

(54) BACKPACK WITH ADJUSTABLY SPACED VENTILATION SYSTEM

(71) Applicant: Ichiro Tatsumi, Tokyo (JP)

(72) Inventor: Ichiro Tatsumi, Tokyo (JP)

( * ) Notice: Subject to any disclaimer, the term of this patent is extended or adjusted under 35 U.S.C. 154(b) by 83 days.

(21) Appl. No.: 15/278,011

(22) Filed: Sep. 27, 2016

(65) Prior Publication Data

US 2017/0181529 A1 Jun. 29, 2017

(51) Int. Cl.
*A45F 3/04* (2006.01)
*A45F 3/12* (2006.01)

(52) U.S. Cl.
CPC ..... *A45F 3/047* (2013.01); *A45F 3/12* (2013.01); *A45F 2003/125* (2013.01)

(58) Field of Classification Search
CPC .... A45F 3/02; A45F 3/04; A45F 3/042; A45F 3/047; A45F 3/06; A45F 3/08; A45F 2003/025; A45F 2003/045; A45F 2003/125
See application file for complete search history.

(56) References Cited

U.S. PATENT DOCUMENTS

| | | | | |
|---|---|---|---|---|
| 5,823,414 | A * | 10/1998 | Gal | A45F 3/04 224/637 |
| 6,685,072 | B2 * | 2/2004 | Ho | A45F 3/04 224/629 |
| 9,821,869 | B2 * | 11/2017 | Armstrong | B62J 9/00 |
| 2004/0134955 | A1 * | 7/2004 | Williams | A45F 3/04 224/644 |
| 2005/0138717 | A1 * | 6/2005 | Le Gal | A45F 3/04 2/102 |
| 2008/0121674 | A1 * | 5/2008 | Yang | A45F 3/04 224/644 |
| 2012/0255983 | A1 * | 10/2012 | Semone | A45F 3/04 224/585 |
| 2017/0027806 | A1 * | 2/2017 | Lin | A61H 7/001 |
| 2017/0181529 | A1 * | 6/2017 | Tatsumi | A45F 3/047 |

FOREIGN PATENT DOCUMENTS

| | | | | |
|---|---|---|---|---|
| DE | 19526764 | A1 * | 1/1997 | A45F 3/04 |
| EP | 1222884 | A1 * | 7/2002 | A47C 21/046 |
| EP | 1550384 | A1 * | 7/2005 | A45F 3/04 |
| FR | 2700252 | A3 * | 7/1994 | A45F 3/04 |
| GB | 2318723 | A * | 5/1998 | A45F 3/04 |
| WO | WO 9719614 | A2 * | 6/1997 | A45F 3/04 |
| WO | WO 9719614 | A3 * | 7/1997 | A45F 3/04 |

* cited by examiner

*Primary Examiner* — Justin M Larson
(74) *Attorney, Agent, or Firm* — Jesse L. London

(57) ABSTRACT

Backpacks with adjustably spaced ventilation systems are disclosed and, more specifically, backpacks whose ventilation systems make minimal contact with the wearer and may be easily disengaged when not desired.

24 Claims, 3 Drawing Sheets

BACKPACK WITH ADJUSTABLY SPACED VENTILATION SYSTEM

PRIORITY CLAIM

This application claims the priority of the Japanese foreign application number 2015-178014 filed on Sep. 6, 2015, the contents of which are incorporated by reference.

FIELD OF THE INVENTION

The present invention relates to backpacks providing adjustable ventilation employing spacers with minimal contact between the spacers on the backpack and the wearer.

BACKGROUND OF THE INVENTION

Conventional backpacks for commuters, hikers, and other active people are often very uncomfortable due to sweat and heat especially on hot summer days due to humidity and body temperature. Numerous backpacks are known in the prior art which have systems for ventilation by creating space for airflow to increase dryness and lower body temperature between the backpack and back of the wearer.

By way of example, Japanese Patent 2004-329801 discloses spacers on the top and the bottom of the backpack. In this prior art, spacers physically contact the wearer's back, support the backpack, and create space for the airflow.

Another example, Japanese Patent 2002-142862, discloses spacers on four corners of the rear of a backpack wherein the middle section of the frame is concave. In this invention also, the spacers on the four corners of the backpack are constantly in contact with the wearer's back. The distinctive feature of such backpacks in the prior art are focused on support of the backpack's load and additionally provide a concave area to create airflow.

Inventions in the prior art disclosing spacers to create ventilation, provide spacers that are in constant in contact with wearer's back even when the wearer experiences no uncomfortableness due to sweat and high humidity. However, because of the contact with said spacers, the wearer experiences uncomfortableness due to said contact as well as the weight and bulk of the spacers.

SUMMARY OF THE INVENTION

The present invention relates to a backpack providing adjustable spacers to create ventilation with minimal contact between the spacers and the wearer only when desirable by the wearer. A primary goal of the present invention is to create ventilation between the wearer and the backpack only when it is desirable to do so. In one preferred embodiment of the present invention, a backpack includes a load compartment; shoulder straps, handle, and spacers coupled to the rear wall of a load compartment wherein the contact and airflow between the wearer and spacers, and therefore the rear wall of the backpack, can be adjusted or eliminated.

The spacers are comprised of a base and an adjustable spacing mechanism wherein said spacing mechanism further comprises a contact member and a means to latch the contact member at different points along an axis of rotation about the base. The base is attached to a rear wall of the backpack facing the wearer and provides a means for fixing the adjustable spacing mechanism. The contact member may be fixed at the base and rotate about said base or unattached wherein said member is inserted and removed from the base at discrete angles of rotation.

A latching means in contact with the contact member fixes the contact member at different angles of rotation such that said member makes contact with wearer's back at different angles which in turn creates a desired differential in space between rear wall and the wearer varying the rate of ventilation. The spacer may be fully engaged when the contact member is at a rotational angle of 90° perpendicular to the base or fully disengaged when said member is at an angle of 0° with respect to the base.

Where directions are used herein to describe regions of the backpack or orientation of components in accordance with the invention, said directions refer, unless another meaning is made explicit or it is clear from context, to a backpack in the upright position according to said backpack's orientation when used in the normal course by a wearer standing upright.

In a preferred embodiment, one spacer is provided on each of the right and left side of the rear wall. In one aspect of the invention, a contact member may be rotated with respect to the base vertically. In another aspect of the invention, a contact member may be rotated laterally.

In a preferred embodiment, a contact member is provided which has intrinsic outward spring force along its wide axis such that it widens providing its own support when contact is made between its extremities and a fixed component. In one aspect of the invention, by way of example, a contact member is flexible metallic wire which has been compressed from a natural state of straightness into a substantially "U" shape with a spring force causing its outside edges to widen. The force from said outside edges can be applied against a fixing means on either side of the member to secure it.

In an important aspect of the invention, a contact member can be fixed at a desired angle of rotation by a latching mechanism which may use notches in contact with the parts of a contact member having spring force acting against said notch to secure it in the fixed position. By providing one or more notches in a fixed plate, the rotating contact member can be compressed to create spring force and then rotated toward a different notch wherein said member widens and is latched at varying desired angles. In another embodiment of the invention, a contact member is inserted into a notch and latched at a desired angle of rotation.

A person skilled in the art will appreciate that the embodiments described herein are by way of example and not limitations on possible embodiments of the inventions.

DETAILED DESCRIPTION OF THE PREFERRED EMBODIMENT

In the following description, specific details are laid out for the purpose of providing a thorough understanding of several embodiments of the present invention. However, one skilled in the art will appreciate that the invention may be practiced without these specific details or in accordance with various combinations of the details. In accordance with the present invention, discomfort due to heat and contact with a backpack by a wearer are reduced by fully adjustable spacers having minimal contact with the wearer which increase or eliminate ventilation.

The present invention can be applied to a wide variety of backpacks for use in commuting, walking, hiking, and other activities in a variety of ambient temperatures. The present invention also has advantages over prior art because embodiments of the invention are significantly customizable without complex production methods or processing, are relatively inexpensive without significantly sacrificing the structural integrity of the backpack.

Figure 1:
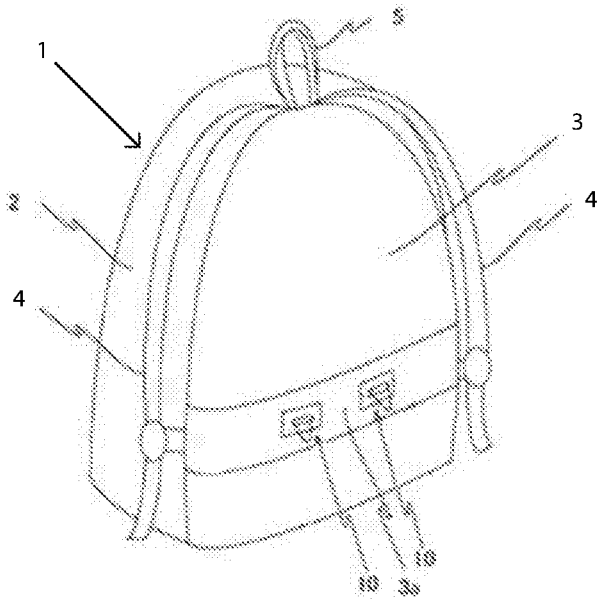
FIG. 1 is a side perspective view of a backpack with spacers according to an illustrated embodiment of the present invention.

FIG. 1 is a perspective view of an exemplary embodiment of a backpack 1 according to the present invention. The embodiment of FIG. 1 is illustrative of the basic structure and function of the present invention in a preferred embodiment comprising a load compartment 2; shoulder straps 4, handle 5, and spacers 10 fixed to a base 3*a*, said base 3*a* coupled to the rear wall 3 of the backpack 1.

The load compartment 2 may be used to carry any items, including, but not limited to food, water, clothing, books, papers, or other items. The rear wall 3 and base 3*a* are the areas that contact the wearer's back directly. Two shoulder straps 4 are fixed at the top and at the bottom of the backpack 1 and used to secure the backpack 1 to the wearer and distribute the load in the load compartment 2 to the wearer's shoulders. These shoulder straps 4 can be adjusted to make them longer or shorter to fit each wearer's body shape and size.

A handle 5 is optionally provided to hang or to carry the backpack 1 and may be formed as a loop and connected on the top of the backpack 1.

In the embodiment illustrated in FIG. 1, the spacers 10 are distributed one each on the right and left of a gap between each other and substantially within the center of a base 3*a* extended from the left to the right of a rear wall 3. When spacers 10 are fully engaged, a maximum amount of space is created between the back of the wearer and the rear wall 3 allowing airflow and creating ventilation. In the illustrated embodiment, the spacing mechanism rotates vertically. The structure of the spacer and its spacing mechanism are described in more detail herein.

Figure 2A:
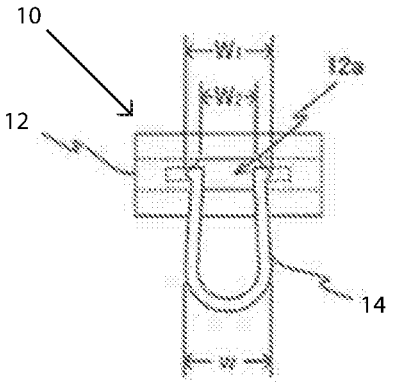
FIG. 2A is a front elevational view of a spacer in a fully disengaged position according to an illustrated embodiment of the present invention.

FIG. 2 and FIG. 3 show detailed structure of a preferred spacer 10 embodiment. FIG. 2 illustrates an embodiment of a spacer fully disengaged such that no contact is made with the wearer and no ventilation is created. FIG. 3 illustrates an embodiment of a spacer fully engaged such that the maximum contact is made with the wearer and maximum ventilation is created.

In the embodiment illustrated in FIG. 2A-2C and FIG. 3A-3C, a spacer 10 comprises an adjustable spacing mechanism attached to a base 3*a*. Said spacing mechanism further comprises a contact member 14 and a means to latch a member 14 at different rotational angles by use of a fixing plate 12 having, relative to the base, one or more convex cylindrical hook receivers 12*b* and one or more notches 12*a*.

Figure 2C:
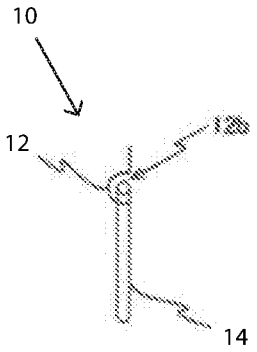
FIG. 2C is a side view of a spacer in a fully disengaged position according to an illustrated embodiment of the present invention.

In a preferred embodiment, the contact member 14 may be made of a metallic wire compressed into a substantially "U" shape having two long cylindrical edges which terminate in a cylindrical hooking edge substantially perpendicular to the long edge. Compression of the member's 14 long edges results in spring force acting outward perpendicular to its long edges such that said long edges widen and force acting in the plane of the hooked edges. As illustrated in FIGS. 2C and 3C, the hooking edge of said member is inserted into the convex hook receivers of the plate 12*b* such that said hooking edges may freely rotate inside the hook receivers about the axis of the plate 12 and are secured by the spring force acting along the plane of the hooked edges against the outside edges of the hook receivers.

Figure 3A:
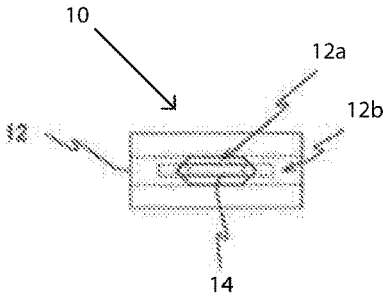
FIG. 3A is a front elevational view of a spacer in a fully engaged position according to an illustrated embodiment of the present invention.
Figure 3C:
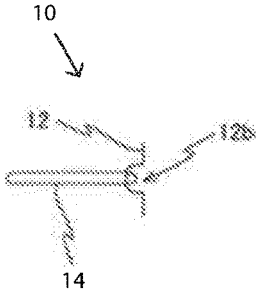
FIG. 3C is a side view of a spacer in a fully engaged position according to an illustrated embodiment of the present invention.
Figure 3B:
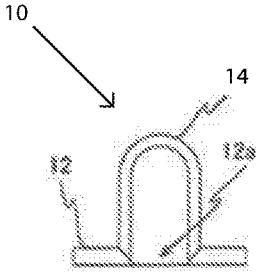
FIG. 3B is a bottom view of a spacer in a fully engaged position according to an illustrated embodiment of the present invention.

FIG. 3A is a front elevation view of a fully engaged spacer 10 at 90° perpendicular to the base 13*a* comprising a substantially "U" shaped contact member 14 as previously described and illustrated fixed to a fixing plate 12. FIG. 3B is a top view illustrating that the contact member creates the greatest ventilation space when it makes contact with wearer's back in its fully engaged position. A fixing plate 12, as illustrated in FIG. 3, may be an extruded rectangle and may be made of metal, plastic, or other substantially stiff material. A fixing plate 12 may be of a hexagonal shape and further comprises one or more recessed notch openings 12*a* where the inside width of the hexagon "W2" is substantially narrower than the outer width "W1." The width "W1" is substantially the same width as the edges of a contact member 14 having a width denoted by "W".

Because the width "W2" is substantially narrower than the width "W" of a contact member 14 having a spring force acting on its outside edges in inverse relation to its width, when the outside edges of width "W" are forceful contact with a part of a notch of width less than "W" the contact member 14 is compressed and can rotate until the it expands to a critical width such that the long edges of the member 14 cannot continue past the notch and thereby latch the member 14 in a fixed position of a desired angle.

Figure 2B:
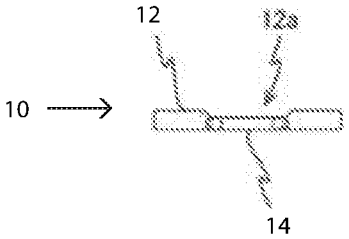
FIG. 2B is a bottom view of a spacer in a fully disengaged position according to an illustrated embodiment of the present invention.

FIG. 2B is top view illustrating that a contact member 14 in the fully disengaged position is flat against the base 13*a* and makes none or trivial contact with the wearer and provides no ventilation space. It is an important aspect of the present invention that the angle formed where contact member 14 makes contact with the wearer need not be 90°, but may be any appropriate angle which achieves the desired amount of ventilation or body temperature.

The "U" shape of the contact member 14 herein described is by way of example only in a preferred embodiment. The contact member 14 in such an embodiment can be any shape if it tends to have sufficient springing force. Likewise, the convex shape of the hook receiver 12*b* can be any shape as long it functions similarly to the cylindrical embodiment in conjunction with an appropriate contact member 14 hooked edge.

In another aspect of the invention, a latching mechanism attached to the base 13*a* or attached to the fixing plate 12 may be used to fix the contact member 14 at a desired angle rather than notches internal to a fixing plate 12.

FIG. 2 and FIG. 3 show detailed structure of a preferred spacer 10 embodiment. FIG. 2 illustrates an embodiment of a spacer fully disengaged such that no contact is made with the wearer and no ventilation is created. FIG. 3 illustrates an embodiment of a spacer fully engaged such that the maximum contact is made with the wearer and maximum ventilation is created.

In an additional embodiment illustrated in FIG. 4A-4B and FIG. 5A-5B, a spacer 20 comprises an adjustable spacing mechanism attached to a base 3*a*. Said spacing mechanism further comprises a contact member 24 and a means to latch a member 24 at different angles by use of a fixing plate 22 having, relative to the base, one or more convex cylindrical hook receivers 22*a* and wherein the plate 22 provides a mechanism for fixing the rotation of the contact member 24.

Figure 4A:
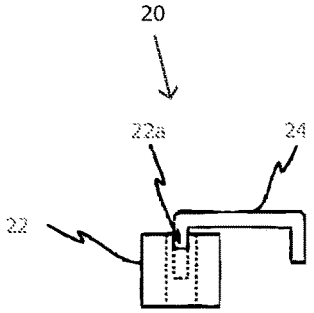
FIG. 4A is a front elevational view of an alternative embodiment of a spacer in a fully disengaged position according to an illustrated embodiment of the present invention.
Figure 4B:
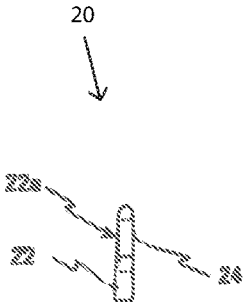
FIG. 4B is a top view of an alternative embodiment of a spacer in a fully disengaged position according to an illustrated embodiment of the present invention.
Figure 5A:
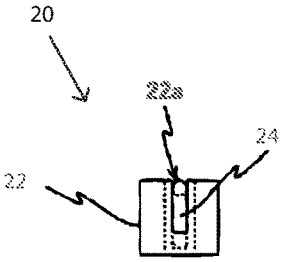
FIG. 5A is a front elevational view of an alternative embodiment of a spacer in a fully engaged position according to an illustrated embodiment of the present invention.

In a preferred embodiment as illustrated in FIG. 4A, the contact member 24 may be made of a metallic wire formed into a squared "C" shape having one long cylindrical edge with a cylindrical hooking edge at each of its extremities. As illustrated in FIGS. 4A and 5A, the hooking edge of said member 24 is inserted into the convex hook receivers of the plate 22 such that said hooking edges are secured inside the hook receivers and the long edge of the member 24 is latched within the protruding edges of the plate 22.

Figure 5B:
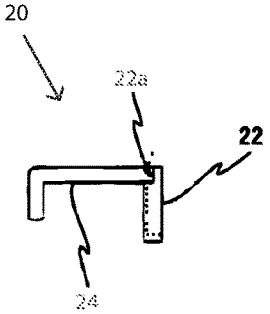
FIG. 5B is a top view of an alternative embodiment of a spacer in a fully engaged position according to an illustrated embodiment of the present invention.

FIG. 5B is a top view of a fully engaged spacer 20 at a 90° angle perpendicular to the base 13*a* having a squared "C" shaped contact member 24 fixed to a fixing plate 22. FIG. 5B illustrates that the contact member 24 creates the greatest ventilation space when it makes contact with the wearer's back in its fully engaged position. A fixing plate 22, as illustrated in FIG. 4 may be an extruded rectangle and may be made of metal, plastic, or other substantially stiff material. A fixing plate 22 further comprises one or more protruding slots 22*a* where each slot has sufficient height to block the rotation of the member 24 and fix it in a position. In a preferred embodiment, said slots may be rectangular solids.

FIG. 4A is front elevation view illustrating that a contact member 14 in the fully disengaged position that is flat against the base 13*a* and makes none or trivial contact with the wearer and provides no ventilation space. It is an important aspect of the present invention that the angle formed where a contact member 24 makes contact with the wearer need not be 90°, but may be any appropriate angle which achieves the desired amount of ventilation or body temperature.

The squared "C" shape of the contact member 24 herein is by way of example only in a preferred embodiment. The contact member 24 in such an embodiment can be any shape if it creates sufficient space between the rear wall 3 and the wearer. Likewise, the shape of the hook receiver 22*a* can be any shape as long it functions similarly to the rectangular embodiment in conjunction with an appropriate contact member 14 hooked edge.

Figure 6:
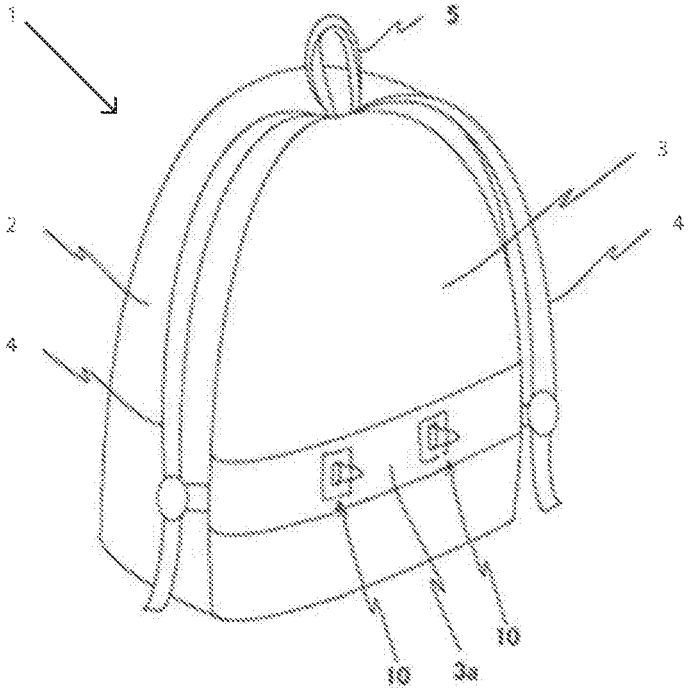
FIG. 6 is a side perspective view of an alternative embodiment of a backpack with laterally rotating contact members according to an illustrated embodiment of the present invention.

FIG. 6 is a side perspective view of an alternative embodiment of the present invention according to all the aforementioned details wherein the spacer 10 operates as previously described with the exception that it is oriented vertically and comprises a contact member that rotates and is fixed laterally.

A person skilled in the art will appreciate that rather than one or two spacers as described by way of example herein, a plurality of three or more spacers may be distributed appropriately in any suitable position on the rear wall 3 such that ventilation is further improved with respect to only one or two spaces distributed. By way of example, significant additional ventilation could be achieved with regard to the embodiments discussed herein by providing a third spacer appropriately in the higher or lower part of the rear wall 3.

A further aspect of the invention is that a material used to cushion or pad a contact member may be provided to reduce shock or increase comfort to the wearer. It is important to note that in a preferred embodiment, the wearer may additional receive benefits of a shiatsu massage as a result of the contact member making repeated contact with sufficient force in certain areas of the wearer's back.

I hereby claim:

1. A backpack comprising
a first spacer coupled to a rear wall facing the wearer wherein said first spacer comprises
an adjustable spacing mechanism and
a base attached to said rear wall;
wherein said adjustable spacing mechanism comprises a contact member which exerts an outward spring force resulting in a widening of the contact member such that a part of said contact member makes contact with a latch whereby said contact member is variably fixed at a desired angle relative to the wearer's back.

2. A backpack comprising
a first spacer coupled to a rear wall facing the wearer wherein said spacer comprises
an adjustable spacing mechanism and
a base attached to said rear wall
wherein a first spacer and a second spacer are provided, one each on the right and left of a rear wall;
wherein a first spacer and a second spacer are fixed along a vertical rotational axis;
wherein said adjustable spacing mechanism comprises a contact member which exerts an outward spring force resulting in a widening of said contact member such that a part of said contact member makes contact with a latch whereby said contact member is variably fixed at a desired angle relative to the wearer's back.

3. A backpack comprising
a first spacer coupled to a rear wall facing the wearer wherein said spacer comprises
an adjustable spacing mechanism and
a base attached to said rear wall
wherein a first spacer and a second spacer are provided, one each on the right and left of a rear wall;
wherein a first spacer and a second spacer are fixed along a lateral rotational axis;
wherein said adjustable spacing mechanism comprises a contact member which exerts an outward spring force resulting in a widening of the contact member such that a part of said contact member makes contact with a latch whereby said contact member is variably fixed at a desired angle relative to the wearer's back.

4. A backpack comprising
a first spacer coupled to a rear wall facing the wearer wherein said first spacer comprises
an adjustable spacing mechanism and
a base attached to said rear wall;

wherein said adjustable spacing mechanism comprises a contact member which exerts an outward spring force resulting in a widening of the contact member such that a part of said contact member makes contact with a latch whereby said contact member is variably fixed at a desired angle relative to the wearer's back;

wherein said first spacer and said second spacer are substantially "U" shaped.

5. A backpack comprising a first spacer coupled to a rear wall facing the wearer wherein said spacer comprises an adjustable spacing mechanism and a base attached to said rear wall wherein a first spacer and a second spacer are provided, one each on the right and left of a rear wall;

wherein a first spacer and a second spacer are fixed along a vertical rotational axis;

wherein said adjustable spacing mechanism comprises a contact member which exerts an outward spring force resulting in a widening of said contact member such that a part of said contact member makes contact with a latch whereby said contact member is variably fixed at a desired angle relative to the wearer's back;

wherein said first spacer and said second spacer are substantially "U" shaped.

6. A backpack comprising a first spacer coupled to a rear wall facing the wearer wherein said spacer comprises an adjustable spacing mechanism and a base attached to said rear wall wherein a first spacer and a second spacer are provided, one each on the right and left of a rear wall;

wherein a first spacer and a second spacer are fixed along a lateral rotational axis;

wherein said adjustable spacing mechanism comprises a contact member which exerts an outward spring force resulting in a widening of the contact member such that a part of said contact member makes contact with a latch whereby said contact member is variably fixed at a desired angle relative to the wearer's back;

wherein said first spacer and said second spacer are substantially "U" shaped.

7. A backpack comprising a first spacer coupled to a rear wall facing the wearer wherein said spacer comprises an adjustable spacing mechanism and a base attached to said rear wall wherein a first spacer and a second spacer are provided, one each on the right and left of a rear wall;

wherein said first spacer and said second spacer comprise two latches formed by a notch or slot making contact with a contact member widening as result of internal spring force thereby variably fixing the contact member at a desired angle.

8. A backpack comprising a first spacer coupled to a rear wall facing the wearer wherein said spacer comprises an adjustable spacing mechanism and a base attached to said rear wall wherein a first spacer and a second spacer are provided, one each on the right and left of a rear wall;

wherein a first spacer and a second spacer are fixed along a vertical rotational axis;

wherein said first spacer and said second spacer comprise two latches formed by a notch or slot making contact with a contact member widening as result of internal spring force thereby variably fixing the contact member at a desired angle.

9. A backpack comprising a first spacer coupled to a rear wall facing the wearer wherein said spacer comprises an adjustable spacing mechanism and a base attached to said rear wall wherein a first spacer and a second spacer are provided, one each on the right and left of a rear wall;

wherein a first spacer and a second spacer are fixed along a lateral rotational axis;

wherein said first spacer and said second spacer comprise two latches formed by a notch or slot making contact with a contact member widening as result of internal spring force thereby variably fixing the contact member at a desired angle.

10. A backpack comprising a first spacer coupled to a rear wall facing the wearer wherein said first spacer comprises an adjustable spacing mechanism and a base attached to said rear wall;

wherein said adjustable spacing mechanism comprises a contact member which exerts an outward spring force resulting in a widening of the contact member such that a part of said contact member makes contact with a latch whereby said contact member is variably fixed at a desired angle relative to the wearer's back;

wherein said first spacer and said second spacer comprise two latches formed by a notch or slot making contact with a contact member widening as result of internal spring force thereby variably fixing the contact member at a desired angle.

11. A backpack comprising a first spacer coupled to a rear wall facing the wearer wherein said spacer comprises an adjustable spacing mechanism and a base attached to said rear wall wherein a first spacer and a second spacer are provided, one each on the right and left of a rear wall;

wherein a first spacer and a second spacer are fixed along a vertical rotational axis;

wherein said adjustable spacing mechanism comprises a contact member which exerts an outward spring force resulting in a widening of said contact member such that a part of said contact member makes contact with a latch whereby said contact member is variably fixed at a desired angle relative to the wearer's back;

wherein said first spacer and said second spacer comprise two latches formed by a notch or slot making contact with a contact member widening as result of internal spring force thereby variably fixing the contact member at a desired angle.

12. A backpack comprising a first spacer coupled to a rear wall facing the wearer wherein said spacer comprises an adjustable spacing mechanism and a base attached to said rear wall wherein a first spacer and a second spacer are provided, one each on the right and left of a rear wall;

wherein said adjustable spacing mechanism comprises a contact member which exerts an outward spring force resulting in a widening of the contact member such that a part of said contact member makes contact with a latch whereby said contact member is variably fixed at a desired angle relative to the wearer's back.

13. A backpack comprising a first spacer coupled to a rear wall facing the wearer wherein said spacer comprises an adjustable spacing mechanism and a base attached to said rear wall wherein a first spacer and a second spacer are provided, one each on the right and left of a rear wall;

wherein the base attached to the rear wall extends latitudinally across the entire length of a rear wall and wherein said first spacer and second spacer are distributed one each on the right and left of said base;

wherein said adjustable spacing mechanism comprises a contact member which exerts an outward spring force resulting in a widening of the contact member such that a part of said contact member makes contact with a latch whereby said contact member is variably fixed at a desired angle relative to the warer's back.

14. A backpack comprising a first spacer coupled to a rear wall facing the wearer wherein said spacer comprises an adjustable spacing mechanism and a base attached to said rear wall;

wherein a first spacer and a second spacer are provided, one each on the right and left of a rear wall;

wherein the base attached to the rear wall extends latitudinally across the entire length of a rear wall and wherein said first spacer and second spacer are distributed one each on the right and left of said base;

wherein a first spacer and a second spacer are fixed along a vertical rotational axis;

wherein said adjustable spacing mechanism comprises a contact member which exerts an outward spring force resulting in a widening of said contact member such that a part of said contact member makes contact with a latch whereby said contact member is variably fixed at a desired angle relative to the wearer's back.

15. A backpack comprising a first spacer coupled to a rear wall facing the wearer wherein said spacer comprises an adjustable spacing mechanism and a base attached to said rear wall wherein a first spacer and a second spacer are provided, one each on the right and left of a rear wall;

wherein said adjustable spacing mechanism comprises a contact member which exerts an outward spring force resulting in a widening of the contact member such that a part of said contact member makes contact with a latch whereby said contact member is variably fixed at a desired angle relative to the wearer's back;

wherein said first spacer and said second spacer are substantially "U" shaped.

16. A backpack comprising a first spacer coupled to a rear wall facing the wearer wherein said spacer comprises an adjustable spacing mechanism and a base attached to said rear wall wherein a first spacer and a second spacer are provided, one each on the right and left of a rear wall;

wherein the base attached to the rear wall extends latitudinally across the entire length of a rear wall and wherein said first spacer and second spacer are distributed one each on the right and left of said base;

wherein said adjustable spacing mechanism comprises a contact member which exerts an outward spring force resulting in a widening of the contact member such that a part of said contact member makes contact with a latch whereby said contact member is variably fixed at a desired angle relative to the wearer's back;

wherein said first spacer and said second spacer are substantially "U" shaped.

17. A backpack comprising a first spacer coupled to a rear wall facing the wearer wherein said spacer comprises an adjustable spacing mechanism and a base attached to said rear wall;

wherein a first spacer and a second spacer are provided, one each on the right and left of a rear wall;

wherein the base attached to the rear wall extends latitudinally across the entire length of a rear wall and wherein said first spacer and second spacer are distributed one each on the right and left of said base;

wherein a first spacer and a second spacer are fixed along a vertical rotational axis;

wherein said adjustable spacing mechanism comprises a contact member which exerts an outward spring force resulting in a widening of said contact member such that a part of said contact member makes contact with a latch whereby said contact member is variably fixed at a desired angle relative to the wearer's back;

wherein said first spacer and said second spacer are substantially "U" shaped.

18. A backpack comprising a first spacer coupled to a rear wall facing the wearer wherein said spacer comprises an adjustable spacing mechanism and a base attached to said rear wall;

wherein a first spacer and a second spacer are provided, one each on the right and left of a rear wall;

wherein the base attached to the rear wall extends latitudinally across the entire length of a rear wall and wherein said first spacer and second spacer are distributed one each on the right and left of said base;

wherein a first spacer and a second spacer are fixed along a lateral rotational axis;

wherein said adjustable spacing mechanism comprises a contact member which exerts an outward spring force resulting in a widening of said contact member such that a part of said contact member makes contact with a latch whereby said contact member is variably fixed at a desired angle relative to the wearer's back;

wherein said first spacer and said second spacer are substantially "U" shaped.

19. A backpack comprising a first spacer coupled to a rear wall facing the wearer wherein said spacer comprises an adjustable spacing mechanism and a base attached to said rear wall;

wherein a first spacer and a second spacer are provided, one each on the right and left of a rear wall;

wherein the base attached to the rear wall extends latitudinally across the entire length of a rear wall and wherein said first spacer and second spacer are distributed one each on the right and left of said base;

wherein said first spacer and said second spacer comprise two latches formed by a notch or slot making contact with a contact member widening as result of internal spring force thereby variably fixing the contact member at a desired angle.

20. A backpack comprising a first spacer coupled to a rear wall facing the wearer wherein said spacer comprises an adjustable spacing mechanism and a base attached to said rear wall;

wherein a first spacer and a second spacer are provided, one each on the right and left of a rear wall;

wherein the base attached to the rear wall extends latitudinally across the entire length of a rear wall and wherein said first spacer and second spacer are distributed one each on the right and left of said base;

wherein a first spacer and a second spacer are fixed along a vertical rotational axis;

wherein said first spacer and said second spacer comprise two latches formed by a notch or slot making contact with a contact member widening as result of internal spring force thereby variably fixing the contact member at a desired angle.

21. A backpack comprising a first spacer coupled to a rear wall facing the wearer wherein said spacer comprises an adjustable spacing mechanism and a base attached to said rear wall wherein a first spacer and a second spacer are provided, one each on the right and left of a rear wall;

wherein the base attached to the rear wall extends latitudinally across the entire length of a rear wall and wherein said first spacer and second spacer are distributed one each on the right and left of said base;

wherein a first spacer and a second spacer are fixed along a lateral rotational axis;

wherein said first spacer and said second spacer comprise two latches formed by a notch or slot making contact with a contact member widening as result of internal spring force thereby variably fixing the contact member at a desired angle.

22. A backpack comprising a first spacer coupled to a rear wall facing the wearer wherein said spacer comprises an adjustable spacing mechanism and a base attached to said rear wall;

wherein a first spacer and a second spacer are provided, one each on the right and left of a rear wall;

wherein said adjustable spacing mechanism comprises a contact member which exerts an outward spring force resulting in a widening of the contact member such that a part of said contact member makes contact with a latch whereby said contact member is variably fixed at a desired angle relative to the wearer's back;

wherein said first spacer and said second spacer comprise two latches formed by a notch or slot making contact with a contact member widening as result of internal spring force thereby variably fixing the contact member at a desired angle.

23. A backpack comprising a first spacer coupled to a rear wall facing the wearer wherein said spacer comprises an adjustable spacing mechanism and a base attached to said rear wall wherein a first spacer and a second spacer are provided, one each on the right and left of a rear wall;

wherein the base attached to the rear wall extends latitudinally across the entire length of a rear wall and wherein said first spacer and second spacer are distributed one each on the right and left of said base;

wherein said adjustable spacing mechanism comprises a contact member which exerts an outward spring force resulting in a widening of the contact member such that a part of said contact member makes contact with a latch whereby said contact member is variably fixed at a desired angle relative to the wearer's back;

wherein said first spacer and said second spacer comprise two latches formed by a notch or slot making contact with a contact member widening as result of internal spring force thereby variably fixing the contact member at a desired angle.

24. A backpack comprising a first spacer coupled to a rear wall facing the wearer wherein said spacer comprises an adjustable spacing mechanism and a base attached to said rear wall;

wherein a first spacer and a second spacer are provided, one each on the right and left of a rear wall;

wherein the base attached to the rear wall extends latitudinally across the entire length of a rear wall and wherein said first spacer and second spacer are distributed one each on the right and left of said base;

wherein a first spacer and a second spacer are fixed along a vertical rotational axis;

wherein said adjustable spacing mechanism comprises a contact member which exerts an outward spring force resulting in a widening of said contact member such that a part of said contact member makes contact with a latch whereby said contact member is variably fixed at a desired angle relative to the wearer's back;

wherein said first spacer and said second spacer comprise two latches formed by a notch or slot making contact with a contact member widening as result of internal spring force thereby variably fixing the contact member at a desired angle.

* * * * *